US007673867B2

(12) United States Patent
Keny et al.

(10) Patent No.: US 7,673,867 B2
(45) Date of Patent: Mar. 9, 2010

(54) FINISHER APPARATUS

(75) Inventors: Chetan Keny, Webster, NY (US); Henry T Bober, Fairport, NY (US); Peter Knausdorf, Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 105 days.

(21) Appl. No.: 11/875,003

(22) Filed: Oct. 19, 2007

(65) Prior Publication Data

US 2009/0102115 A1 Apr. 23, 2009

(51) Int. Cl.
*B65H 33/04* (2006.01)
*B65H 39/00* (2006.01)
*B65H 43/02* (2006.01)

(52) U.S. Cl. ..... 270/58.12; 270/58.07; 270/58.08; 270/58.11; 270/58.27

(58) Field of Classification Search ..... 270/58.07, 270/58.08, 58.09, 58.11, 58.12, 58.17, 58.27
See application file for complete search history.

(56) References Cited

U.S. PATENT DOCUMENTS

| | | | | |
|---|---|---|---|---|
| 3,709,595 | A * | 1/1973 | Turner et al. | 399/410 |
| 3,957,264 | A * | 5/1976 | Bach et al. | 271/287 |
| 4,340,213 | A * | 7/1982 | Jensen | 271/219 |
| 4,789,150 | A * | 12/1988 | Plain | 271/220 |
| 6,547,238 | B2 * | 4/2003 | Ardery et al. | 271/209 |
| 7,055,818 | B2 * | 6/2006 | Furusawa | 271/220 |
| 7,571,904 | B2 * | 8/2009 | Bober | 270/58.12 |

* cited by examiner

*Primary Examiner*—Gene Crawford
*Assistant Examiner*—Yolanda Cumbess

(57) ABSTRACT

A flexible strip of low coefficient of friction material is attached to a paddle wheel hub and placed over a predetermined length of the drive side of the paddle wheel blades in order to reduce the drive force of the paddle wheel blades on the top sheet in a stack to thereby allow the accurate compiling of a greater range of curled sheets.

20 Claims, 6 Drawing Sheets

FINISHER APPARATUS

This invention relates in general to an image forming apparatus, and more particularly, to an image forming apparatus employing a finisher with an improved compiler apparatus.

Heretofore, some conventional finishers included a compiler system having a near horizontal compiler tray 13 and a frictional sheet drive element, such as, a paddle wheel as shown in prior art FIGS. 1 and 2 that use shaft mounted paddle blades 11 and 12 to register sheets against a registration edge or wall 14. The number of blades on a paddle wheel varied from 1 to 2 or more. Compiler 10 shows a low stack height in FIG. 1 and not much paddle blade deflection and a high stack height in FIG. 2 and more paddle blade deflection. Paddle blades 11 and 12 are typically controlled by motor and controller 15 by the use of home position sensor 17 and home position flag 20. As the sheet enters compiler tray 13 through conveying rolls 21 and 22, rotating elastomer paddle wheel blades 11 and 12 contact the top of the trailing edge of the incoming sheet, pushes it down against the top of the stack and draws the sheet against the registration edge 14 as shown in prior art FIG. 3. Once all of the sheets have entered the compiler tray, deskewed and registered, the set is then ready for stapling and eject. However, as the stack height builds up, as shown by the major bending of blade 12 in FIG. 3, deflection of the paddle blades increases and both the normal force and frictional drive forces from the blades on the top sheet of the stack increases exponentially. If the drive force becomes too high, the top sheet can buckle against the compiler tray edge 14 as shown in FIG. 3. This condition contributes to degraded stapled sheet sets and customer dissatisfaction.

It is typical for compiler systems to either index the tray or the compiler drive element, i.e., the paddle wheel shaft to maintain a more constant top sheet to paddle wheel shaft gap, and thus, a more constant top sheet drive force. But, this requires an indexing drive mechanism and a method of measuring or counting sheets to estimate the stack height relative to the compiler element. This adds cost and complexity to the compiler system and could impact cycle time productivity.

Various approaches have been tried toward controlling sheets as they enter a catch tray, but none appear to totally answer the above-mentioned need. For example, a sheet stacking apparatus with a print deflecting flap is disclosed in U.S. Pat. No. 4,340,213. The print deflecting flap ensures that an extremely curled sheet or print cannot rise over a top portion of a stop member. In U.S. Pat. No. 4,789,150 dual independently acting control flaps are disclosed to provide positive control of sheet being stacked in a sheet stacking apparatus by controlling the trail edges, as well as, the entire sheets as they are fed to a catch tray.

However, there is still a need for a compiler system that has less drive force sensitivity to stack height build up, is more robust, indexes less frequently, is less complex and less costly.

Accordingly, an improved compiler system is disclosed that increases compiler latitude by including a low friction shield which covers a portion of the blade closest to the root and contacts a sheet stack during a high stack and high blade deflection condition. The shield reduces the drive force of a paddle blade, allowing a greater range of stack heights with desired compiling behavior.

The disclosed system may be operated by and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'printer' or 'reproduction apparatus' as used herein broadly encompasses various printers, copiers or multifunction machines or systems, xerographic or otherwise, unless otherwise defined in a claim. The term 'sheet' herein refers to any flimsy physical sheet or paper, plastic, or other useable physical substrate for printing images thereon, whether precut or initially web fed. A compiled collated set of printed output sheets may be alternatively referred to as a document, booklet, or the like. It is also known to use interposers or inserters to add covers or other inserts to the compiled sets.

As to specific components of the subject apparatus or methods, or alternatives therefor, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Figure 1:
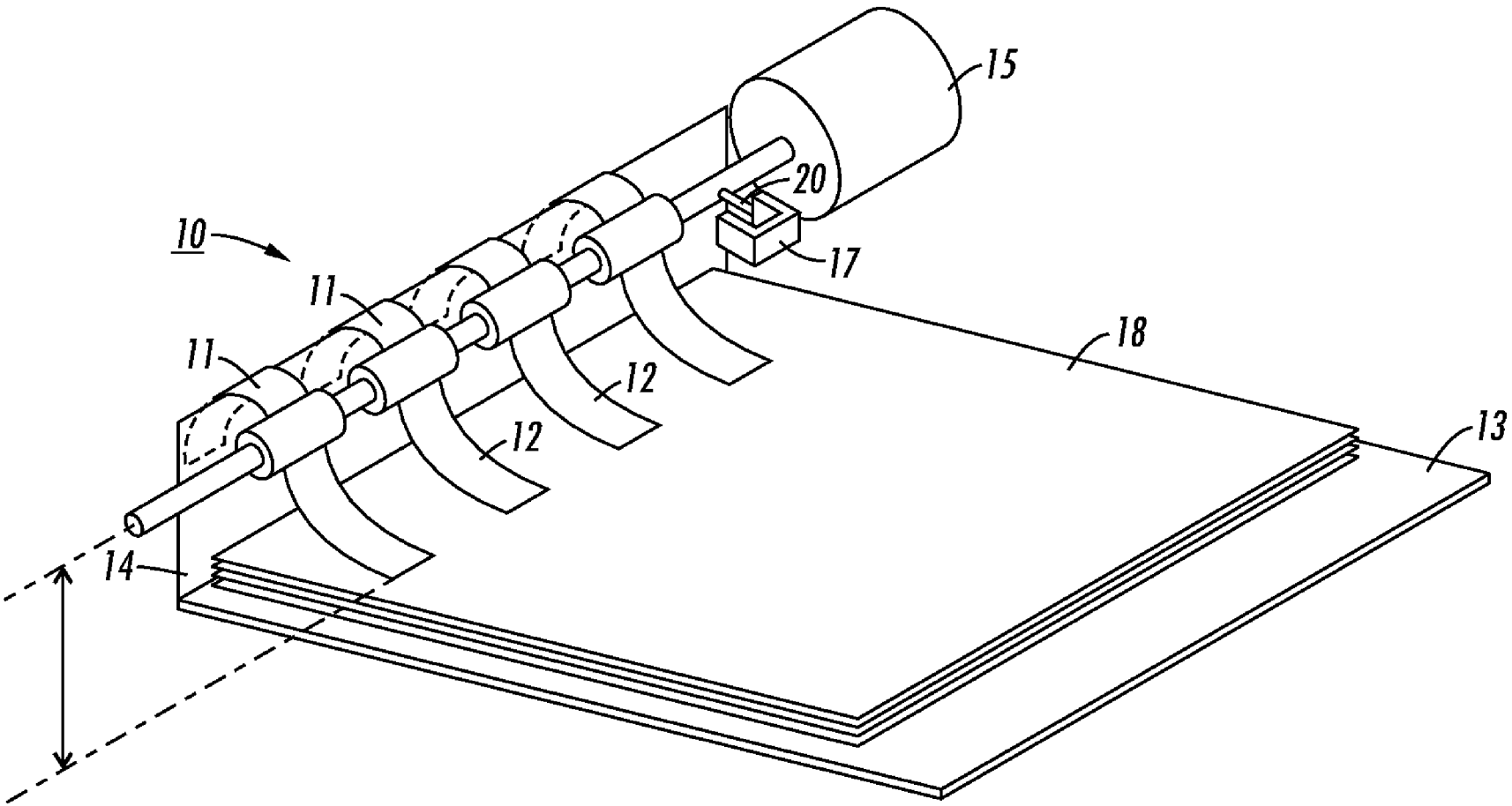
FIG. 1 (PRIOR ART)
FIG. 1 is partial perspective view of a prior art finisher compiling station showing low stack paddle wheel blade deflection.
Figure 2:
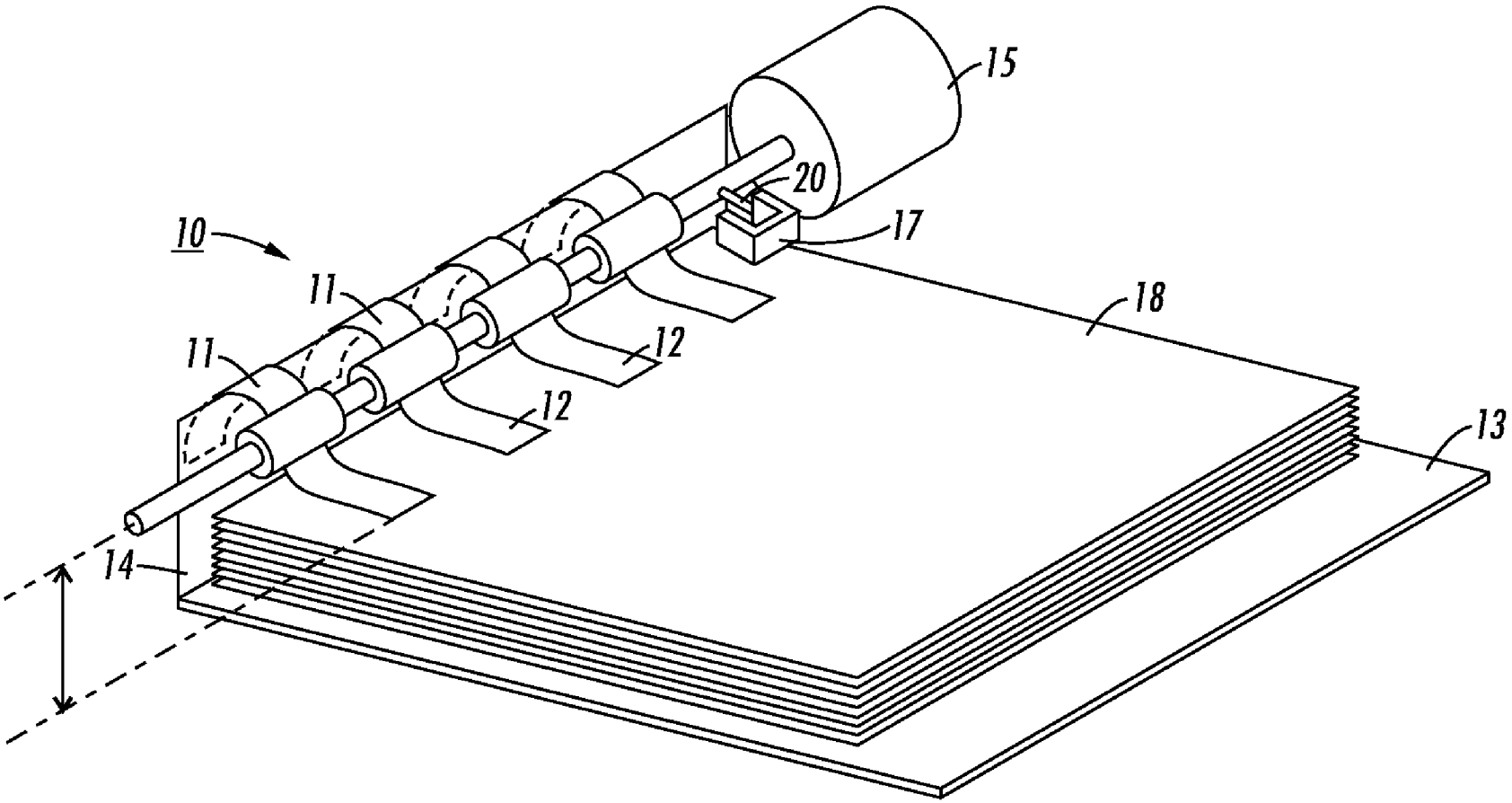
FIG. 2 (PRIOR ART)
FIG. 2 is partial perspective view of the prior art finisher compiling station of FIG. 1, showing high stack paddle wheel blade deflection.
Figure 3:
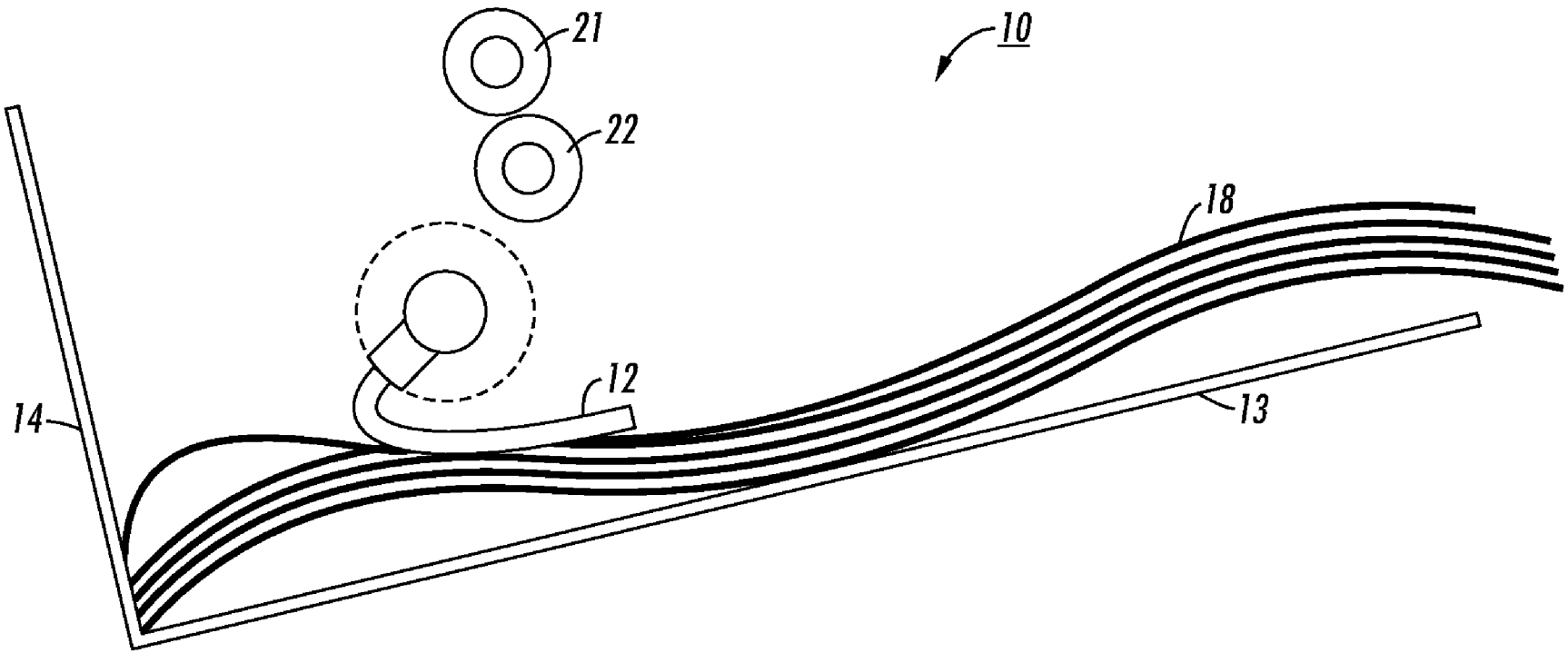
FIG. 3 (PRIOR ART)
FIG. 3 is a side view of the prior art compiler of FIG. 1 showing down curled media.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to a preferred embodiment xerographic printing apparatus that includes an improved compiler apparatus.

For a general understanding of the features of the disclosure, reference is made to the drawings. In the drawings, like reference numerals have been used throughout to identify identical elements.

Figure 4:
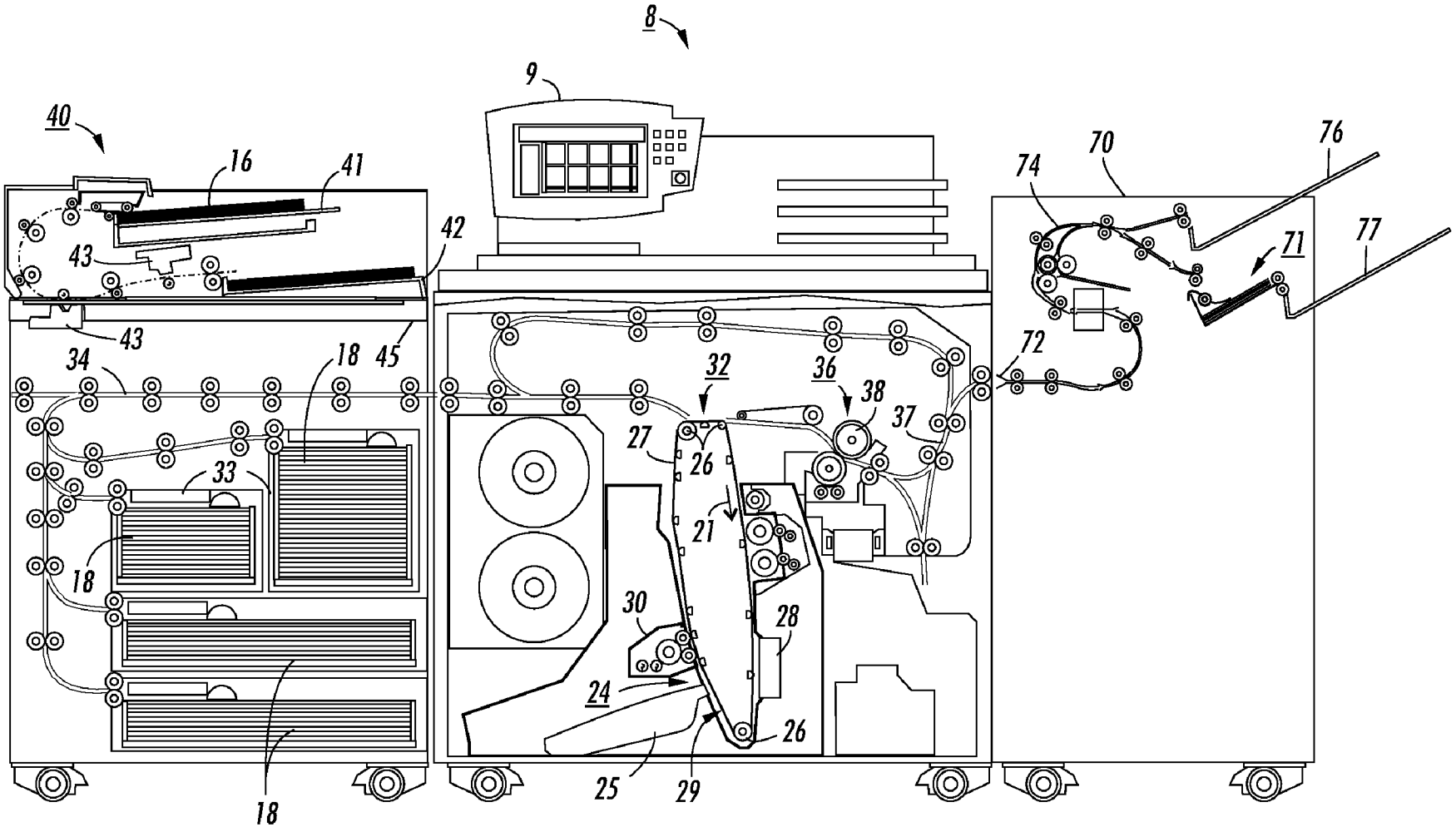
FIG. 4 is an exemplary modular xerographic printer that includes the improved compiler system for a finisher of the present disclosure.

Referring to printer 8 of FIG. 4, as in other xerographic machines, an electronic document or an electronic or optical image of an original document or set of documents to be reproduced may be projected or scanned onto a charged surface 29 of a photoreceptor belt 27 to form an electrostatic latent image. Optionally, an automatic document feeder 40 (ADF) may be provided to scan at a scanning station 43 paper documents 16 fed from a tray 41 to a tray 42. The document handler or automatic document feeder 40 is clamshell connect by conventional hinges (not shown) to scan tub 45. The latent image is developed with developing material to form a toner image corresponding to the latent image. The toner image is then electrostatically transferred to a final print media material, such as, paper sheets 18, to which it may be permanently fixed by a fusing device 36. The machine user may enter the desired printing and finishing instructions through the graphic user interface (GUI) or control panel 9, or, with a job ticket, an electronic print job description from a remote source, or otherwise.

As the substrate passes out of the nip, it is generally self-stripping except for a very lightweight one. The substrate requires a guide to lead it away from the fuser roll. After separating from the fuser roll, the substrate is free to move along a predetermined path toward the exit of the printer 8 in which the fuser structure apparatus is utilized.

The belt photoreceptor 27 here is mounted on a set of rollers 26. At least one of the rollers is driven to move the photoreceptor in the direction indicated by arrow 21 past the various other known xerographic processing stations, here a charging station 28, imaging station 24 (for a raster scan laser system 25), developing station 30, and transfer station 32. A sheet 15 is fed from a selected paper tray supply 33 to a sheet transport 34 for travel to the transfer station 32. Paper trays 33 include trays adapted to feed the long edge of sheets first from a tray (LEF) or short edge first (SEF) in order to coincide with the LEF or SEF orientation of documents fed from tray 41 that is adapted to feed documents LEF or SEF depending on a user's desires. Transfer of the toner image to the sheet is affected and the sheet is stripped from the photoreceptor and conveyed to a fusing station 36 having fusing device 38 where the toner image is fused to the sheet. The sheet 18 is then transported by a sheet output transport 37 to the finishing station 70 where plural sheets 18 may be accumulated to be compiled into superposed sets or sheets and optionally fastened together (finished) by being stapled.

With further reference to FIG. 4, a simplified elevational view of a finisher module, generally indicated as 70, is shown printed sheets from the printer 8 are accepted in an entry port 72. Depending on the specific design of the finisher module 70, there may be numerous paths, such as, 74 and numerous output trays 76 for print sheets. It is to be understood that various rollers and other devices which contact and handle sheets within finisher module 70 are driven by various motors, solenoids and other electromechanical devices (not shown), under a control system, such as including a microprocessor (not shown), within the finisher module 70, printer 8, or elsewhere, in a manner generally familiar in the art.

Finisher 70 has a top tray 76 and a main tray 77. The top tray 76 is used as a purge destination, as well as, a destination for the simplest of jobs that require no finishing and no collated stacking. A compiler tray 71 has a pair of pass-through 100 sheet upside down staplers (not shown) and is used for most jobs that require stacking or stapling. Sheets that do not require stapling are forwarded along path 74 to top tray 76. Sheets that require stapling are forwarded along path 74, stapled in the compiler tray at and deposited into the main tray or lower tray of the output trays 77.

Figure 5:
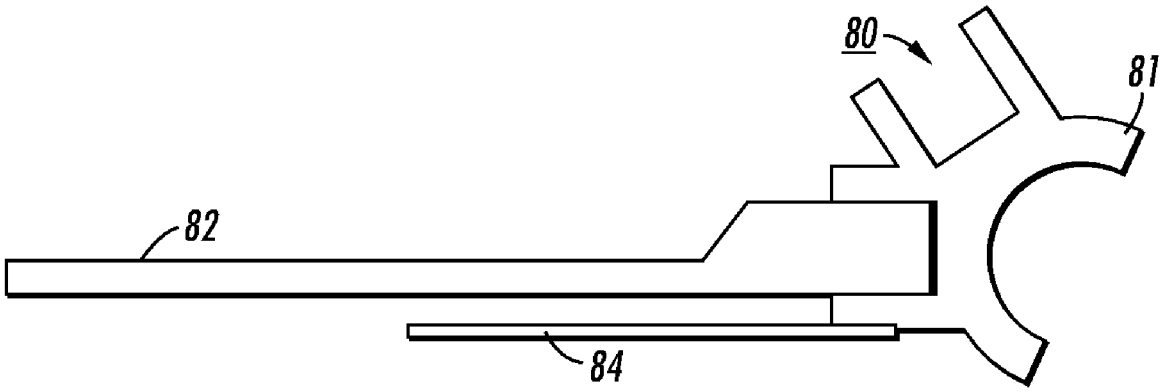
FIG. 5 is a side view of a paddle wheel that includes a standard paddle blade and a shield positioned beneath it in accordance with the present disclosure.

One embodiment of the improved compiler system of the present disclosure includes a paddle wheel 80 and shield 84 as shown in FIG. 5. The paddle wheel 80 includes a paddle wheel hub 81 into which a paddle blade 82 is inserted or otherwise attached. The shield 84 is positioned between paddle blade 82 and the top sheet of the compiled sheet stack. In this position, the shield mutes the high drive force generated due to increased normal force at high stack heights. The length of the shield or liner is used to moderate the drive force at higher stack heights and thereby reduces sheet buckling. That is, a flexible strip of a low coefficient of friction material, such as, plastic is attached to the paddle wheel hub and placed over a carefully predetermined length of the drive side of the paddle wheel blade (two or more paddle wheels with more than one blade can be positioned along the shaft on which each paddle wheel hub is mounted). Preferably, the paddle blade coefficient of friction is about 1.0 and the shield coefficient of friction is about 0.25. As the stack height increases in the compiler tray, the sheet contact zone lengthens and moves up the blade from near the tip to towards the root. As this occurs, the normal force increases exponentially with stack height. By tailoring the length (starting point) of the low coefficient of friction plastic membrane, the most rapidly increased part of the blade contact pressure distribution has a much muted contribution to the top sheet drive force, in spite of the greater normal force. The shield is also helpful in compressing or de-fluffing the curled sheet stack because it permits the coexistence of the increasing blade normal force without the debilitating effects of the usually associated increased top sheet drive force.

Figure 6:
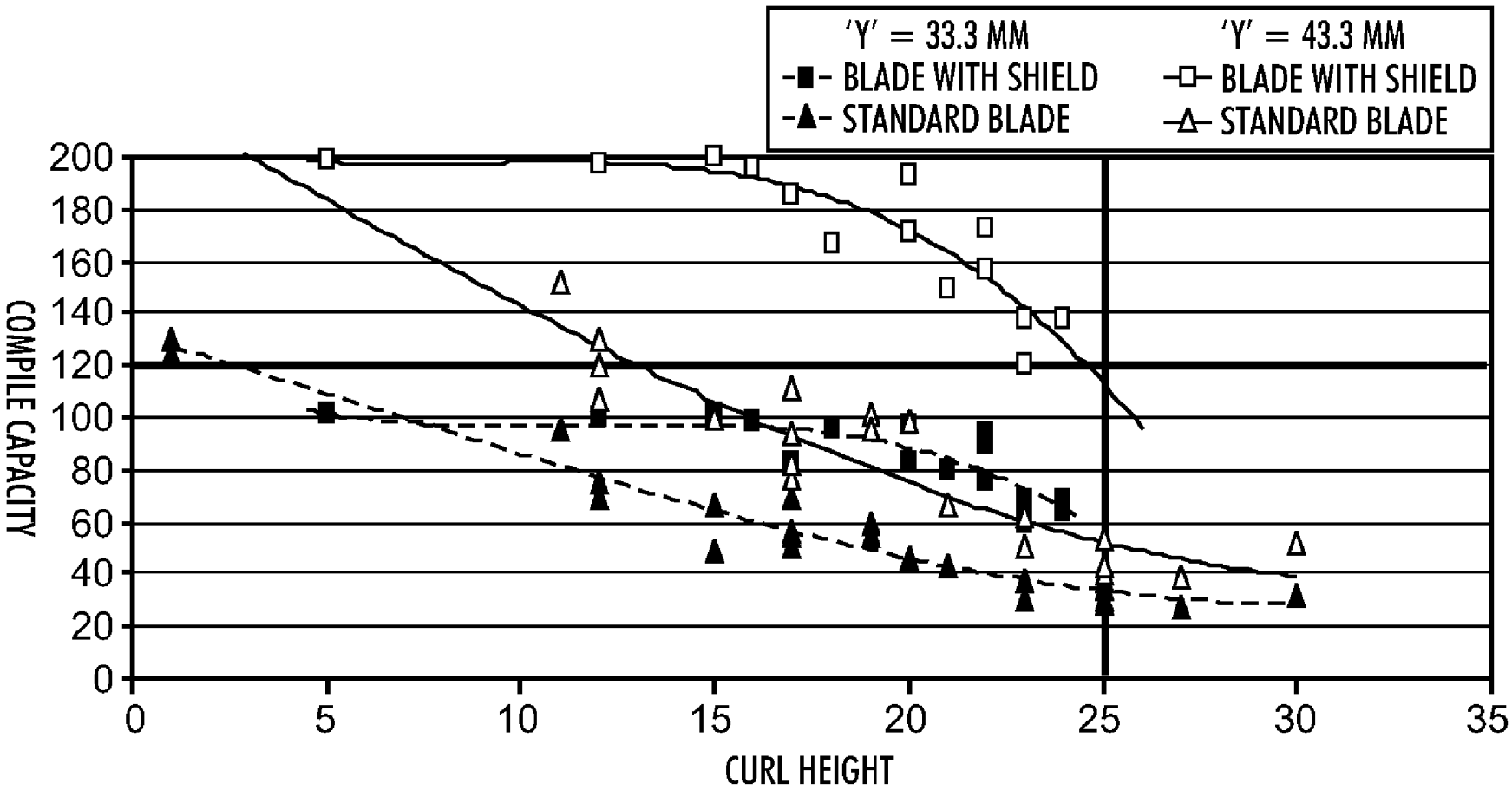
FIG. 6 is a chart showing an increase in compile capacity with the introduction of the shield adjacent the paddle blade of FIG. 5.

The chart in FIG. 6, shows test results conducted with 60 gsm down curled sheets with no paddle wheel shaft indexing, standard 55 mm blade set, tested at two paddle wheel shaft center line to tray support surface gaps of 'y'=33.3 mm and 'y'=43.3 mm (representing the initial and maximum indexed paddle wheel shaft centerline positions above the compile tray for the specific embodiment tested) and a shield length of 34 mm. As can be seen, the introduction of the low coefficient of friction shield increases compile capacity and modifies the shape of the capacity curve. For example, with 'y' at 33 mm, compiling is markedly improved for curled sheets between 10 and 25 mm of curl with the shield attached as oppose to the standard blade without a shield attached. Other geometric sized compiler trays would have blade and shield lengths that could be optimized through experimentation [DoE] or analytical simulation, etc.

It should now be seen that the operating latitude of paddle wheel compiler systems has been increased by modification of existing paddle wheels to include standard paddle blades with an elastomeric shield positioned between each paddle blade and the top sheet in a stack. The shield reduces the drive force of the paddle blades at higher stack heights, thus allowing the accurate compilation and registration of a greater range of stack heights of curled sheets to be accomplished.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A printing apparatus, comprising:

a scanning member positioned to read images on documents positioned thereover and forward image data for further processing;

an image processor that receives the image data from said scanning member and processing it;

at least one copy sheet feed tray adapted to feed copy sheets to receive images thereon from said image processor; and a finishing system adapted to receive the imaged copy sheets, said finishing system including a compiler system including a tray for receiving the copy sheets and compiling them into a stack, a stapler for stapling said copy sheets and a drive member for forwarding them as sets to an output tray, said compiler system including at least one paddle wheel having a hub with at least one paddle blade connected directly to said hub and extending orthogonally therefrom, and wherein said at least one paddle wheel includes a flexible shield connected directly to and extending orthogonally from said hub and positioned between said at least one paddle blade of said at least one paddle wheel and the top copy sheet of sheets stacked in said tray and configured to reduce drive force of said paddle blade against said stack in order to allow compiling of a greater range of stack heights with desired compiling behavior.

2. The printing apparatus of claim 1, wherein said flexible shield reduces the drive force of said at least one paddle blade only when said stack reaches a predetermined height.

3. The printing apparatus of claim 2, wherein said paddle blade and said flexible shield are closely spaced.

4. The printing apparatus of claim 2, wherein said at least one paddle wheel blade has a coefficient of friction of about 1.0.

5. The printing apparatus of claim 4, wherein said shield has a coefficient of friction of about 0.25.

6. The printing apparatus of claim 5, wherein said at least one paddle wheel blade is made of an elastomer.

7. The printing apparatus of claim 6, wherein said flexible shield is made of plastic.

8. A xerographic device adapted to print an image onto a copy sheet, comprising:

an imaging apparatus for processing and recording an image onto said copy sheet;

an image development apparatus for developing the image;

a transfer device for transferring the image onto said copy sheet;

a fuser for fusing the image onto said copy sheet; and a finishing system adapted to receive the imaged copy sheets, said finishing system including a compiler a tray for receiving the copy sheets and compiling them into a stack, a paddle wheel device for registering the copy sheets within said compiler tray, a stapler for stapling said copy sheets and at least one drive member for conveying them as sets to an output tray, said paddle wheel device including at least one paddle wheel having a hub and with at least one paddle blade attached directly thereto, and wherein said hub includes a flexible member attached directly thereto and positioned between said at least one paddle blade and the top copy sheet in said compiler tray.

9. The xerographic device of claim 8, wherein said flexible member is made of plastic and extends perpendicularly from said hub.

10. The xerographic device of claim 9, wherein said paddle blade is an elastomer and extends perpendicularly from said hub.

11. The xerographic device of 10, wherein said flexible member is configured to reduce drive force of said at least one paddle blade against copy sheets in said stack in order to allow compiling of a greater range of stack heights of curled copy sheets.

12. The xerographic device of claim 11, wherein said flexible member extends a predetermined distance along the length of said at least one paddle blade.

13. The xerographic device of claim 11, wherein said at least one paddle wheel blade has a coefficient of friction of about 1.0.

14. The xerographic device of claim 13, wherein said flexible member has a coefficient of friction of about 0.25.

15. A method for printing images onto copy sheets, comprising:

providing an imaging apparatus for processing and recording an image onto each of said copy sheets;

providing an image development apparatus for developing the image;

providing a transfer device for transferring the image onto said copy sheets;

providing a fuser for fusing the image onto said copy sheets; and providing a finishing system adapted to receive the imaged copy sheets, said finishing system including a compiler a tray for receiving the copy sheets and compiling them into a stack, a paddle wheel device for registering the copy sheets within said compiler tray, a stapler for stapling said copy sheets and a conveying device for conveying them as sets to an output tray, said paddle wheel device including at least one paddle wheel including a hub with at least one paddle blade attached directly thereto, and wherein said hub includes a flexible member attached directly thereto and positioned beneath said at least one paddle blade and between said at least one paddle blade and the top copy sheet in said compiler tray.

16. The method of claim 15, including making said at least one paddle wheel blade of an elastomer.

17. The method of claim 16, wherein said flexible member is plastic.

18. The method of claim 17, including extending said flexible member a predetermined distance along the length of said at least one paddle blade.

19. The method of claim 16, wherein said at least one paddle wheel blade has a coefficient of friction of about 1.0.

20. The method of claim 15, wherein said flexible member has a coefficient of friction of about 0.25.

* * * * *